US008813647B2

(12) United States Patent
Hauck et al.

(10) Patent No.: US 8,813,647 B2
(45) Date of Patent: Aug. 26, 2014

(54) METHOD AND DEVICE FOR DETERMINING REGISTER DEVIATIONS THROUGH RECURSION ANALYSIS

(75) Inventors: Axel Hauck, Karlsruhe (DE); Stefan Schreiber, Hassfurt/Sylbach (DE); Uwe Tessmann, Schwetzingen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 276 days.

(21) Appl. No.: 12/890,840

(22) Filed: Sep. 27, 2010

(65) Prior Publication Data

US 2011/0079160 A1 Apr. 7, 2011

(30) Foreign Application Priority Data

Oct. 1, 2009 (DE) ..... 10 2009 047 963

(51) Int. Cl.
*B41F 33/14* (2006.01)
*B41F 33/00* (2006.01)

(52) U.S. Cl.
USPC ..... 101/484; 101/481

(58) Field of Classification Search
CPC ..... B41F 33/0036; B41F 33/0081; B41F 33/0045; B41F 33/0009; B41P 2233/11
USPC ..... 101/480, 486, 485, 484
See application file for complete search history.

(56) References Cited

U.S. PATENT DOCUMENTS 4,532,596 A * 7/1985 Pugsley ..... 700/125
4,606,633 A 8/1986 Jeschke et al.
4,878,753 A * 11/1989 Nestmeier ..... 356/237.1
5,258,925 A 11/1993 Maier et al.
5,696,890 A * 12/1997 Geissler et al. ..... 358/1.9
6,050,192 A * 4/2000 Kipphan et al. ..... 101/232
6,119,594 A 9/2000 Kipphan et al.
7,453,223 B2 11/2008 Buck et al.
7,559,276 B2 7/2009 Mutschler et al.
7,637,210 B2 12/2009 Geissler et al.
2008/0115679 A1* 5/2008 Petersen ..... 101/211
2008/0314268 A1* 12/2008 Billmaier et al. ..... 101/211

FOREIGN PATENT DOCUMENTS

DE 3800877 A1 7/1989
DE 4005558 A1 9/1991
DE 4321179 A1 1/1995
DE 19738992 A1 3/1999
DE 10318571 A1 11/2003
EP 0000328 A1 1/1979

OTHER PUBLICATIONS

German Search Report dated May 10, 2010.

* cited by examiner

*Primary Examiner* — Ren Yan
*Assistant Examiner* — Leo T Hinze
(74) *Attorney, Agent, or Firm* — Laurence A. Greenberg; Werner H. Stemer; Ralph E. Locher

(57) ABSTRACT

A method and a device for determining color register and lateral register deviations on printing material during production in multi-color printing presses, include a computing unit which takes into consideration the influence of ghosting effects when measuring the deviations on the printing material. The ghosting effects of at least one preceding and/or one succeeding printed image are recursively taken into consideration in the computing unit, when measuring on the printing material.

16 Claims, 7 Drawing Sheets

METHOD AND DEVICE FOR DETERMINING REGISTER DEVIATIONS THROUGH RECURSION ANALYSIS

CROSS-REFERENCE TO RELATED APPLICATION

This application claims the priority, under 35 U.S.C. §119, of German Patent Application DE 10 2009 047 963.5, filed Oct. 1, 2009; the prior application is herewith incorporated by reference in its entirety.

BACKGROUND OF THE INVENTION

Field of the Invention

The present invention relates to a device and a method for determining register deviations on printing material in multi-color printing presses during production, using a computing unit which takes into consideration the influence of ghosting effects when measuring the deviations on the printing material.

In lithographic offset printing and other additive printing processes, a number of color separations of a printed image are printed on top of each other to produce a multi-colored printed image. The positioning of the individual color separations with respect to each other is referred to as the color register. The positioning of the superimposed color separations with respect to a predetermined margin on the printing material is referred to as the lateral register. If the positioning of the color separations is correct in both of those respects, the product may be referred to as an in-register print. In the following description, "register" is understood to include both the color register and the lateral register. In order to determine register deviations, it has become known to use register measuring devices which measure register marks pertaining to the lateral and color register on the printing material to be measured for the purpose of determining deviations. However, due to disruptions in the operation of a lithographic offset printing press, so-called ghosting effects may occur, which likewise cause the individual color separations to become offset or shifted relative to each other. That means that a conventional register measuring device does not exclusively determine register deviations, but also superposed deviations caused by ghosting. Thus, the important issue is to distinguish between deviations caused by ghosting and true register deviations, because otherwise the control drives for the compensation of register deviations cannot be appropriately controlled and deviations would persist.

The problem of ghosting effects is also known, for example, from Published German Patent Application DE 38 00 877 A1, corresponding to U.S. Pat. No. 4,878,753. In that document, a method of measuring offset caused by ghosting in printing presses is described. In accordance with that method, a test halftone pattern is printed onto a printing material and sensed by two sensors. Those sensors feed the gray values of the test pattern to a ghosting detection device. Ghosting effects can be detected based on the measurements and the geometric relation between the test strips. That method is likewise suitable for use in a printing press, allowing the detection of ghosting effects during a print run. The sensors substantially determine ghosting offsets, which are characterized by the fact that next to a fresh, solidly colored halftone dot there is a ghosting shadow which is matt and frequently of smaller diameter.

Published European Patent Application EP 0 000 328 A1, corresponding to U.S. Pat. No. 4,606,633, discloses a measuring process and a device for determining defects on printing material. In accordance with that method, remission values on a printing material are determined and evaluated by computation. Ghosting effects are determined and taken into consideration in order to calculate the correct halftone value on the printing material. If desired, the ghosting effects are displayed on a screen for a printing press operator to examine them.

A disadvantage of the prior art is that although the existing measuring devices can be used to determine ghosting effects, they are only taken into consideration with respect to a correct evaluation of halftone values. So far, register measuring devices are incapable of taking ghosting effects into consideration, thus leading to correspondingly erroneous results when determining register deviations.

SUMMARY OF THE INVENTION

It is accordingly an object of the invention to provide a method and a device for determining register deviations on printing material through recursion analysis, which overcome the hereinafore-mentioned disadvantages of the heretofore-known methods and devices of this general type, which take the influence of ghosting effects into consideration when measuring register deviations on printing material and which need only one measuring process to determine the deviations.

With the foregoing and other objects in view there is provided, in accordance with the invention, a method for determining color register and lateral register deviations on printing material during production in multi-color printing presses. The method comprises taking an influence of ghosting effects into consideration in a computing unit when measuring the deviations on the printing material. The ghosting effects of at least a preceding and/or a succeeding printed image are taken recursively into consideration in the computing unit, when measuring on the printing material.

With the objects of the invention in view, there is also provided a device for measuring deviations relating to color register and/or lateral register on printing material during production in printing presses. The device comprises a computing unit configured to take an influence of ghosting effects into consideration when measuring the deviations on the printing material. The computing unit is configured to take the ghosting effects on at least one preceding or/and on at least one succeeding printed image into consideration when determining deviations on the printing material.

In accordance with another mode of the method of the invention, the register deviations including the ghosting effects contained therein as they are determined on a printing material through the use of a register measuring device in a measuring process are fed to a computing unit. This computing unit then determines the proportion of the ghosting effects in the measured deviations by recursively taking into consideration at least the ghosting effects of a preceding and/or succeeding printed image. This means that the method not only includes the determining of ghosting effects in a printed image on a printing material as in the prior art, but also the taking into consideration of ghosting effects of a number of succeeding printed images on a number of printed sheets or on a web of printing material. This approach is based on a model in which the calculation of the ghosting effects is done through recurring to the resultant register fluctuations on a number of printed images. In this manner, it is possible to distinguish the ghosting effects caused by vibrations from register deviations and to separate the superimposed effects so that it is possible to factor out the proportion of the register deviations and to suitably correct only these deviations by giving adjustment commands to register control drives in the printing press. If the ghosting effects were not factored out, erroneous adjustment values would be supplied to the register adjustment drives in the printing press, and the control system would not work properly. Nevertheless, the method and device of the invention do not require a second measurement to determine the ghosting effects. Instead, it is sufficient to measure out the printed image through the use of a register measuring device without requiring the use of special measuring devices for determining ghosting effects. The present invention is suited in particular for use in sheet-fed rotary printing presses.

In accordance with a further particularly advantageous embodiment of the invention, the ghosting effects of up to 5 preceding and/or succeeding printed images are taken into consideration. This number has proved to be sufficient in practice. In this context, if the printing material is in the form of sheets, it is of particular importance to measure the sheets in the correct order in which they are successively produced in the printing press. This is, in particular, the case if the sheets are measured by a separate measuring device after they have been removed from the printing press. If, in contrast, the measuring device is disposed in the printing press downstream of the last printing unit, the measuring of the printing material is guaranteed to be in the correct order.

In order to be able to separate the influences of ghosting effects from register deviations, the present invention makes use of a recursion analysis. The recursion analysis takes into consideration color shifts of halftones in the Lab color space. These color shifts can be used to calculate the system behind the ghosting effects and thus to separate the influence of the ghosting effects from the register deviations.

In accordance with an added embodiment of the invention, the line width of register marks on the printing material is determined to detect register deviations under the assumption that the prints transferred from printing plate to printing material or intermediate print carrier are identical. In lithographic offset printing, the intermediate print carrier is usually a rubber blanket. In this context, the line width of the register marks is at first not known as an absolute value, but may be calculated from a recursion analysis under the assumption indicated above. The method of the invention may be applied during continuous printing and prior to the actual printing operation during the start-up phase of the printing press.

In accordance with a concomitant mode of the invention, the device may be a conventional hand-held register measuring device. This conventional register measuring device either may include a computing unit to carry out the recursion analysis or it may be connected to a suitable computing unit. Moreover, a register measuring device of this kind may be integrated into a color measuring device. A considerable advantage of this aspect is that only one measuring process is required to establish both color measurement values and register measurement values. If, in particular, such a combined measuring device is disposed in the last printing unit of the printing press, it is thus possible to establish color measurement values and register measurement values in each printed image.

Other features which are considered as characteristic for the invention are set forth in the appended claims.

Although the invention is illustrated and described herein as embodied in a method and a device for determining register deviations through recursion analysis, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
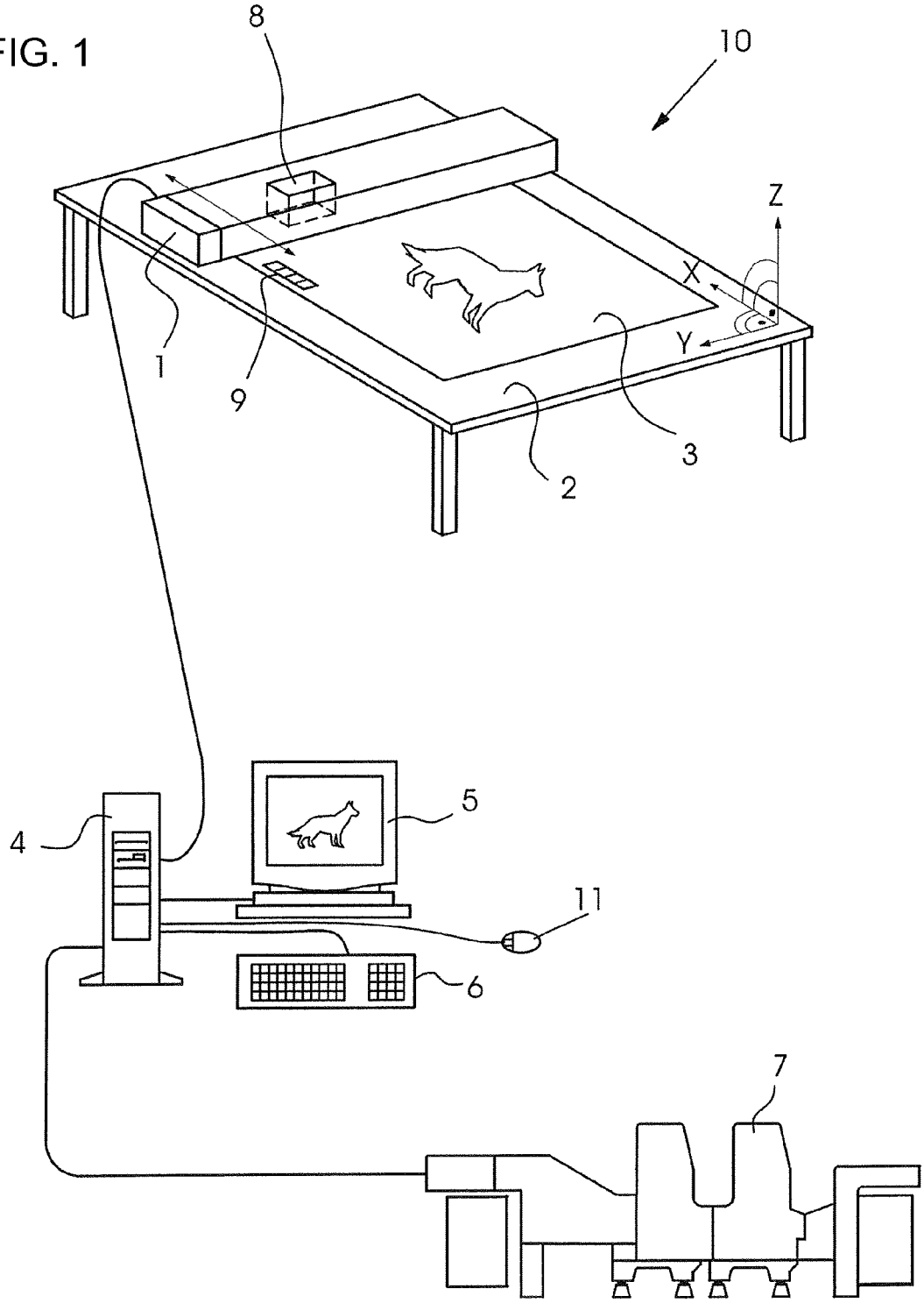
FIG. 1 is a diagrammatic, partly perspective and partly elevational view of a combined register and color measuring device which is connected to a computing unit, that is in turn connected to a printing press.

Referring now to the figures of the drawings in detail and first, particularly, to FIG. 1 thereof, there is seen a combined register and color measuring device 10, which has a measuring bar 1 with a combined measuring head 8. The measuring head 8 is driven electrically to move across the entire extent of a printed image on a sheet-shaped printing material 3 resting on the measuring device. In the process, the measuring bar 1 moves in a direction X whereas the measuring head 8 in the measuring bar 1 moves in a direction Y. Thus, the measuring head 8 is capable of sensing any desired image dot on the sheet 3. In order to carry out the measuring process, the sheet 3 is placed underneath the measuring bar 1 on a measuring table 2. A printed measuring mark 9 can be seen on a margin of the sheet 3. This measuring mark 9 may include both color measuring patches and register marks which are sensed by the measuring device. The measuring device 10 feeds measured color and register values to a computing unit 4.

However, an inherent problem with the measured register values is that they include proportions of ghosting effects. Those influences of ghosting effects are filtered out in the computing unit through the use of the recursion analysis explained below, in order to determine actual register deviations. Based on the actual register deviations that have been determined in this way, the computing unit 4 may calculate correction values for a lithographic offset printing press 7 connected to the computing unit 4. As an alternative to fully automatic control, these correction values may be displayed to the operating staff on a screen 5. An operator may then use a keyboard 6 or a computer mouse 11 connected to the computing unit 4 to release the correction values and to feed them to the printing press 7. The correction values may be converted at the printing press to corresponding actuating commands for register adjustment drives in the printing press 7 to counteract register deviations that have been determined.

Figure 2:
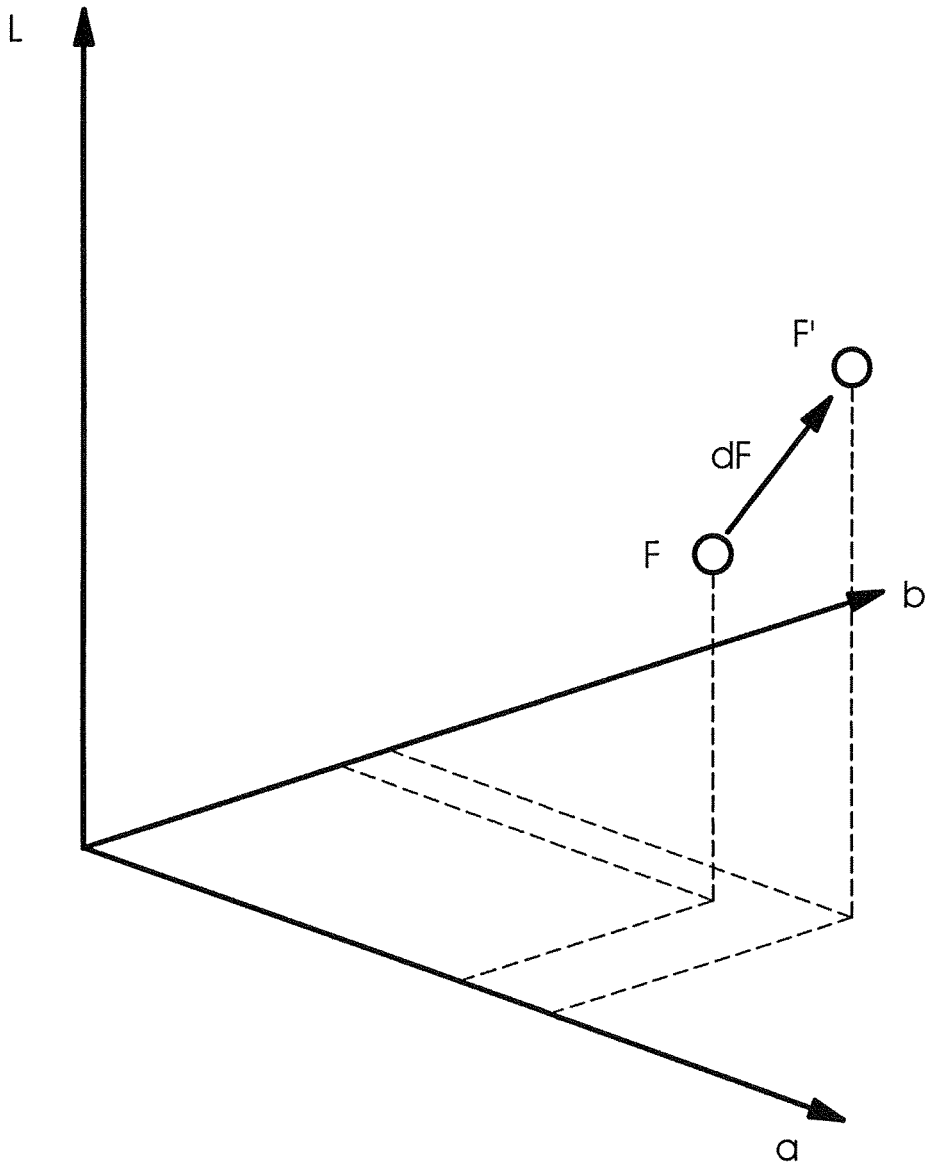
FIG. 2 is a diagram illustrating a simple example for color shifts in the Lab color space.

By way of example, FIG. 2 illustrates a shift of a color location of a halftone dot on the printing material 3 in the Lab color space. The color location F of a halftone dot can be seen to have been shifted to a color location F' due to ghosting effects. This shift or displacement from the correct color location F to the color location F' caused by ghosting, may be expressed by a color location shift vector dF.

Figure 3:
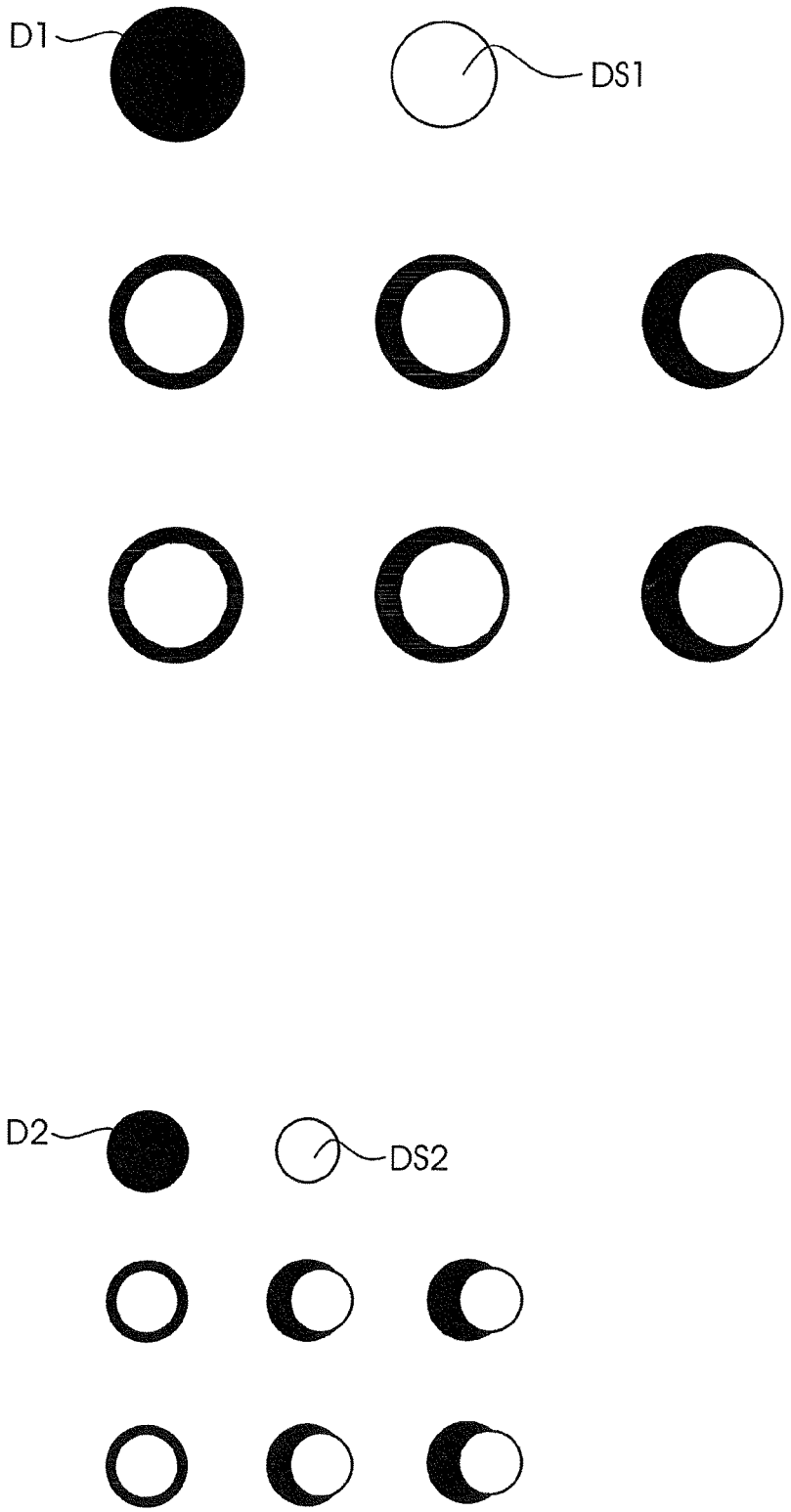
FIG. 3 is a perspective view illustrating the formation of ghosting shadows around halftone dots.

This color location shift dF is created by a so-called ghosting shadow illustrated in FIG. 3. Ghosting shadows are created when non-dried image dots on the sheet 3 are reprinted onto a rubber blanket in downstream printing units of a printing press 7 under the influence of sheet travel disruptions, for example caused by vibrations in the printing press. Due to those disruptions, halftone dots which have been reprinted in the downstream printing units and are visibly weaker in color, are not printed exactly on top of each other but rather with a slight degree of offset. That effect becomes visible as a ghosting shadow which enlarges the image dot. In the upper region of FIG. 3, a halftone dot D1 having a diameter of 100 μm is shown as having a ghosting shadow DS1 that is 80 μm in diameter. In the lower half of the image, a halftone dot D2 having a diameter of 50 μm is shown as having a ghosting shadow DS2 that is 40 μm in diameter. This representation is based on the realistic assumption that the size of the ghosting shadow is approximately 80% of that of the original halftone dot D1, D2. In the first column, the ghosting shadow disappears behind the halftone dot because the offset between halftone dot and ghosting shadow is 0 μm. In the second column, halftone dot and ghosting shadow are offset by 10 μm relative to each other. In the third column, this offset has increased to 30 μm. As can be seen in the figure, such a degree of offset visibly affects print quality and produces erroneous measurement results when halftone dots are measured to determine register deviations.

Figure 4:
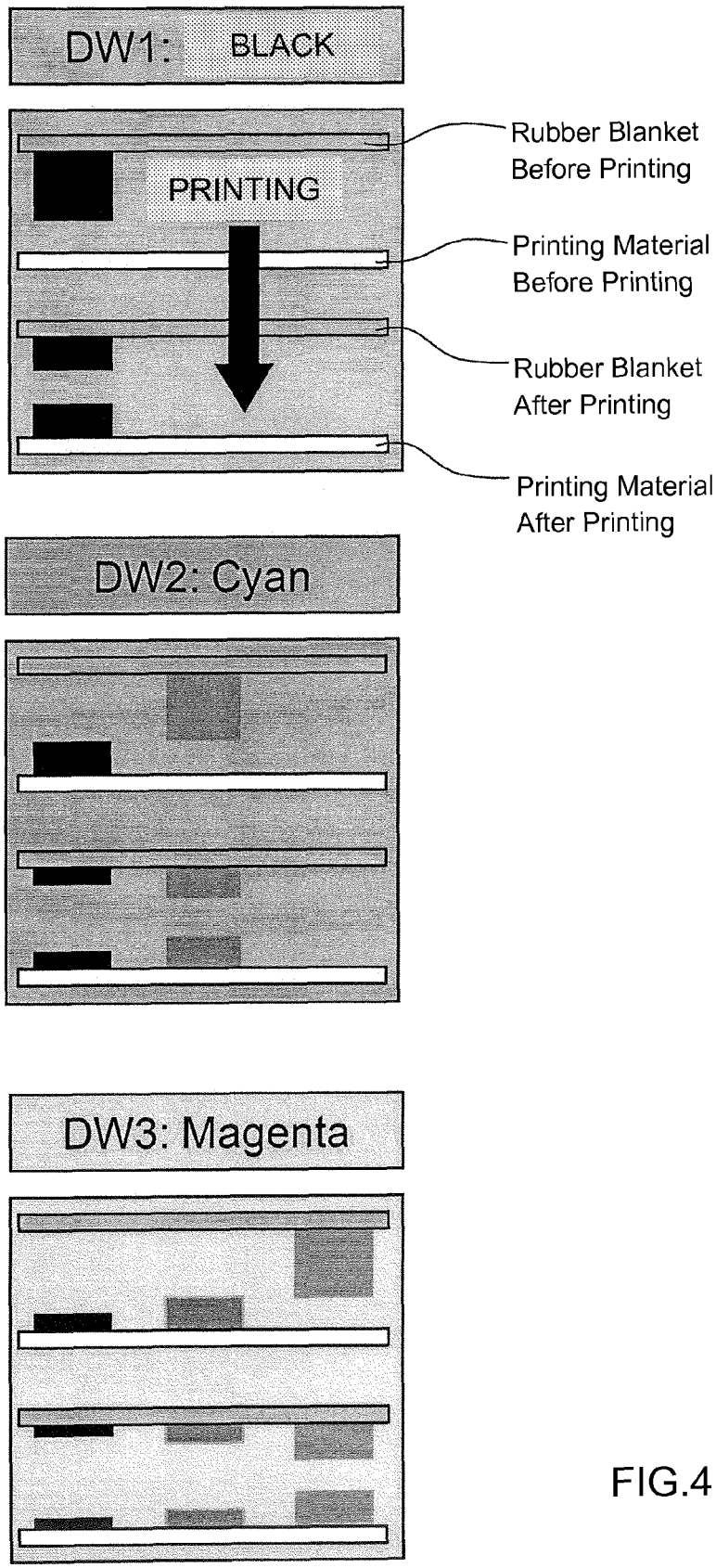
FIG. 4 is a flow diagram illustrating a printing process including three process colors with ink build-up on a blanket of a lithographic offset printing press.

FIG. 4 illustrates an ink build-up of a halftone dot on the rubber blanket in three printing units of the printing press 7 during the printing operation. A first printing unit DW1 prints the color black, a second printing unit DW2 prints the color cyan, a third printing unit DW3 prints the color magenta. In the first printing unit DW1, only black dots are created on the blanket because only unprinted sheets 3 from the feeder reach this printing unit. When the color cyan is printed onto the printing material in the second printing unit DW2, black portions are printed onto the blanket as the blanket rolls on the printing material 3. These black portions are reprinted from the blanket onto the sheet 3. In the same manner, black and cyan portions from the upstream printing units DW1 and DW2 are reprinted onto the printing material 3 in the third printing unit DW3 in addition to the magenta portion since cyan and black portions have likewise been deposited on the blanket in the third printing unit DW3 and are printed onto the sheets 3 from there.

Figure 5:
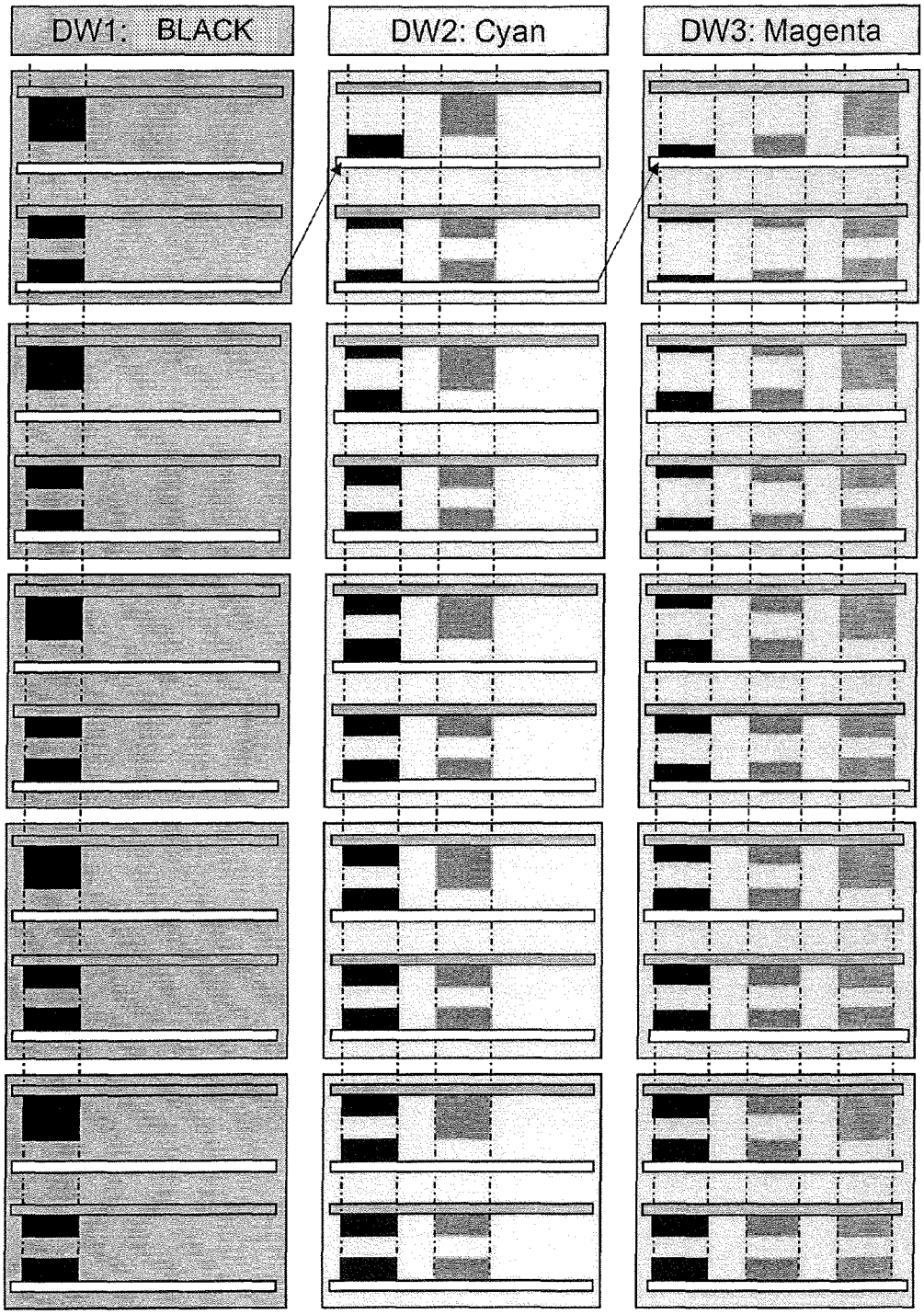
FIG. 5 is a flow diagram illustrating a printing operation in a start-up phase of a printing press without disrupting influences.

FIG. 5 illustrates the printing operation in the first three printing units of the printing press 7 during the start-up phase without any sheet travel disruption.

Figure 6:
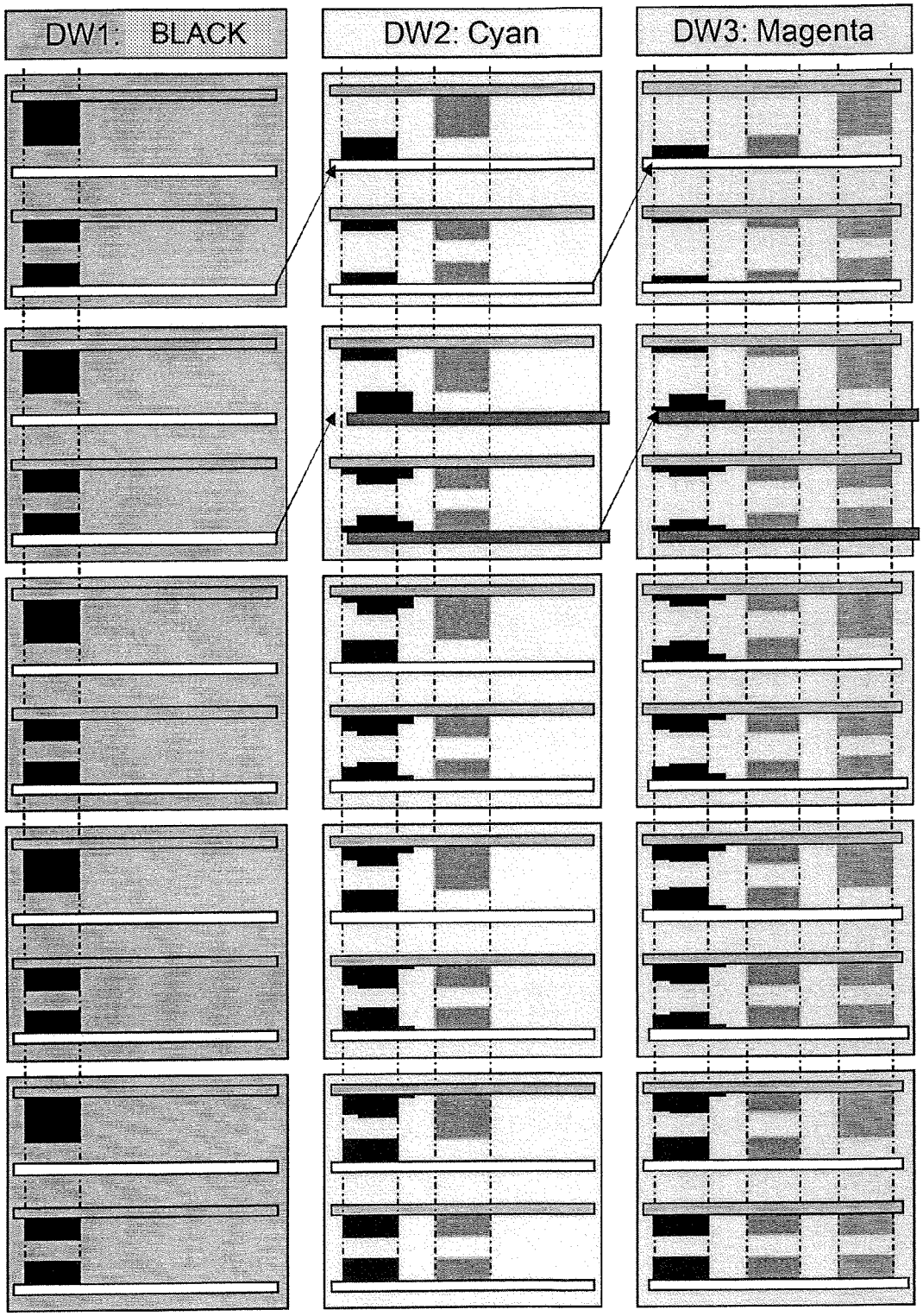
FIG. 6 is a flow diagram illustrating a printing operation in a start-up phase of a printing press with disruptions concerning sheet travel.

FIG. 6 likewise illustrates the printing operation in the start-up phase. However, in FIG. 6 a sheet travel disruption occurs between the first and second printing units DW1 and DW2 after the second sheet. As a result, in the downstream printing units DW2 and DW3, the reprinted halftone dots are offset and corresponding ghosting effects occur.

Figure 7:
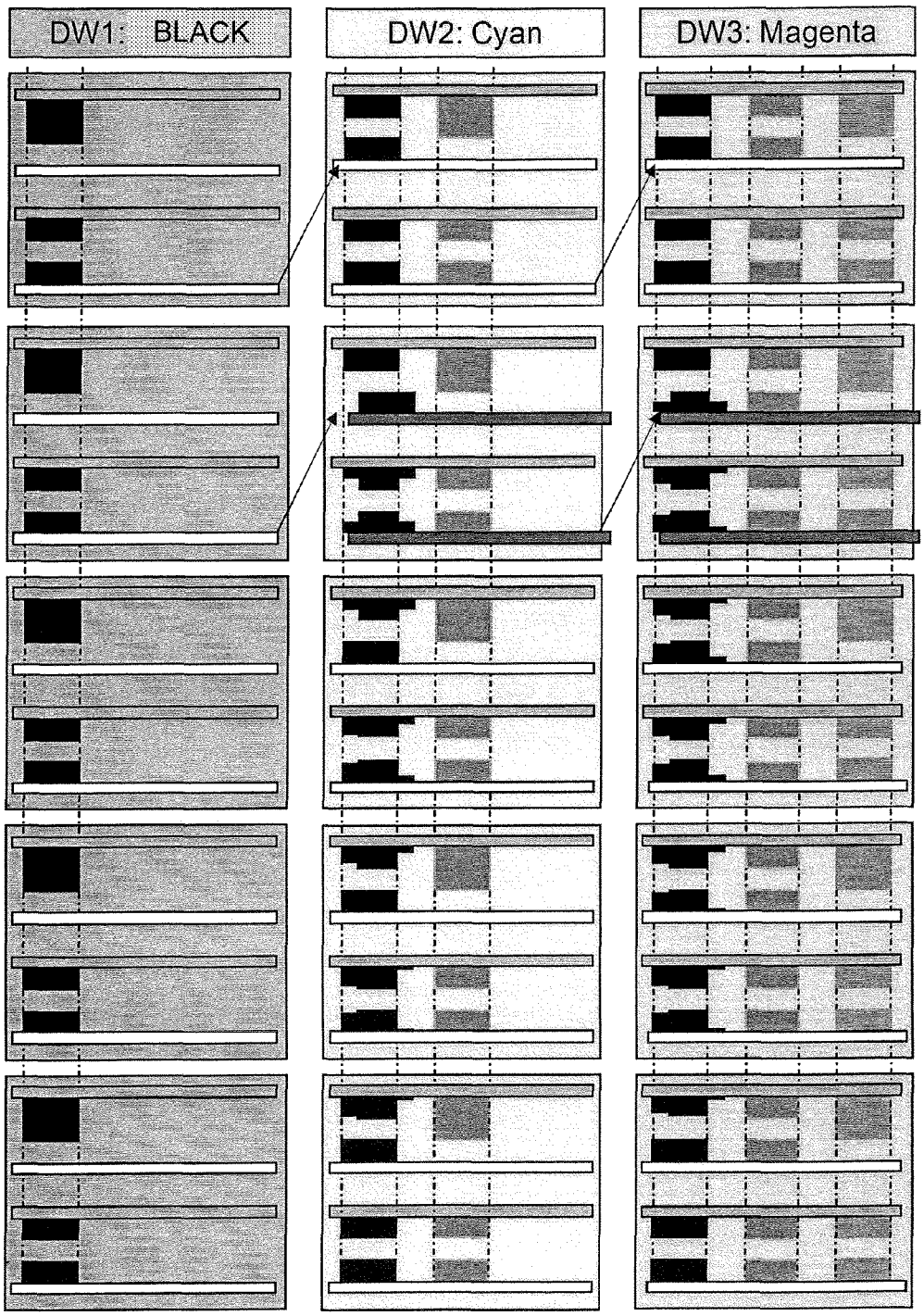
FIG. 7 is a flow diagram illustrating a stationary printing operation during a continuous print run upon a disruption concerning sheet travel.

FIG. 7 illustrates a stationary printing operation during a continuous print run, likewise with a sheet travel disruption. The figure shows that in this case ghosting effects likewise occur due to an offset of the reprinted halftone dots on the blanket. This offset causes the halftone dots of the color black, for example, to be overprinted on subsequent sheets 3 by the halftone dots reprinted in printing units DW2 and DW3 on the blankets. Since these halftone dots are not located precisely on top of each other, the black dots receive a ghosting shadow. Thus, the ghosting shadow is created because ink from upstream printing units is present on the blanket of downstream printing units and because these superimposed halftone dots are not located precisely on top of each other, i.e. are offset relative to each other due to sheet travel disruptions. Those ghosting shadows are factored out through the use of the recursion analysis according to the invention described below, so that correct measuring of register deviations is possible even when ghosting effects occur.

When a number of color separations A_j, j=1 . . . m (m=number of printing units) are printed together, the desired color impression F=f( . . . , A_j, . . . ), j=1 . . . m is created with paper white and as a result of the autotypical ink mixing of the color separations that are printed on top of one another. This color impression may be identified unequivocally through the use of a metric as an ordered triple (L, a, b) in the Lab color space (also refer to FIG. 2). Due to influencing or disruptive factors (such as the color density of the individual separations, the topology and ink accepting properties of the printing material, etc.) the desired color impression shifts to a color impression F'=(L', a', b'). The difference between the two states is described by a vector dF=(L'-L, a'-a, b'-b). Through the use, for instance, of an IT 8.7/3 color chart, a multiplicity (number I) of different halftone patches with color impressions F_k, k=1 . . . I are printed. If a disruption occurs at the sheet transfer between printing units j and j+1, for example, depending on the printing order, a number o of the I halftone patches will experience a characteristic tonal shift dF_j, j=1 . . . o.

Further elements are conceivable as an alternative to the IT 8.7/3 color chart. A halftone dot that is subject to ghosting effects experiences an area coverage gain which depends on its absolute size because it is a "fringe effect." A certain minimum register deviation is necessary for the ghosting shadow to become visible beyond the original image (refer to FIG. 3). If the halftone dot is large, the area coverage gain is smaller than if the halftone dot is small. Thus, the tonal shifts to be expected can be influenced by choosing suitable halftone dot sizes.

The influence of an individual color separation A_j or of a transfer Ü_j/j+1 on a color impression F of the I halftone patches may be described by a model:

F_k=f( . . . , A_j, Ü_j/j+1), k=1 . . . I. If all I halftone patches are measured and the actual color impressions F' are determined, due to dF=(L'-L, a'-a, b'-b) the result is a characteristic shift patch of the color hues in the Lab color space. As described above, the values for the o halftone patches that are concerned is different than zero. The magnitude of the disruption that has caused the effect may be determined by reverse calculation. This reverse calculation may also be done by using a model that has been empirically determined and by using recursion analysis.

In a manner analogous to current methods used by register measuring devices, it is additionally possible to determine an overall shift/ghosting value for each color separation and to integrate this value as additional information into the model described above, yet without directional information.

The model on which the calculation is based, in particular takes into consideration the instant at which a color dot is being printed. For this reason, it is imperative that the sheets 3 be measured in a defined order.

The method described above gives information on both the quality and the quantity of a disruption in the image or sheet transport at a certain location in the printing operation. A certain memory effect is inherent in the printing process: a disruption in the front region of the printing press 7 has an effect on the succeeding printing processes (refer to FIGS. 5 to 7), i.e. on the printing processes carried out in downstream printing units after the disruption has occurred. Consequently, the color impression and thus the measured values to be established on a sheet j are affected by disruptions that occurred when the sheets j−1, j−2 were printed. In turn, the sheet j has an influence on the values of the following sheets j+1, j+2. In general, the influence is limited to approximately −/+5 adjacent sheets 3.

Allowing for this fact, a recursive improvement of the measured results may be achieved. Just as in current methods, as a first step, a measured value for the position of the color separations is determined as a starting value for the recursion. As soon as a second sheet 3 is measured or rather as soon as a second measured value is available, information on a possible variation between sheet j and sheet j+1 is available. Through the use of the model described above, an estimation of the ghosting influence affecting the measurement may be made. This is then used to improve ghosting shadow correction of the sheet j+1. If precisely the value of ghosting shadow correction is output separately in addition to the register measuring value, a further important piece of information is obtained by one measurement per image dot on the sheet 3, namely information on the magnitude of the ghosting effect, which directly correlates with the visual impression.

A further factor is the line width of the measuring mark 9, which is not known at first as an absolute value. Based on the assumption that the original image is always printed identically from the printing plate to the blanket, the line width may likewise be obtained from the recursion.

The invention claimed is:

1. A method for determining color register and lateral register deviations on printing material during production in multi-color printing presses, the method comprising the following steps:

determining ghosting effects on the printing material with a register measuring device measuring the printing material in a measuring process;

feeding register deviations, including the ghosting effects contained therein as determined during the measuring process, to a computing unit; and calculating the ghosting effects of the measured printing material by recursively calculating at least the ghosting effects of a preceding and/or succeeding printed image as an impact on the measured printing material using calculation software run in the computing unit.

2. The method according to claim 1, wherein the printing material is in the shape of sheets.

3. The method according to claim 1, which further comprises taking the ghosting effects of up to 5 preceding and succeeding printed images into consideration.

4. The method according to claim 1, which further comprises separating register deviations and influence of ghosting effects by recursion analysis in the computing unit.

5. The method according to claim 4, which further comprises taking color shifts of halftone dots in the Lab color space into consideration in the recursion analysis.

6. The method according to claim 5, which further comprises taking an instant at which a halftone dot is printed in the printing press into consideration in the recursion analysis.

7. The method according to claim 4, which further comprises taking an instant at which a halftone dot is printed in the printing press into consideration in the recursion analysis.

8. The method according to claim 1, which further comprises determining register deviations by determining a line width of measuring marks on the printing material with the computing unit under an assumption of identical print transfer from printing master to printing material or intermediate print carrier.

9. The method according to claim 1, which further comprises carrying out the method prior to execution of an actual printing job in a start-up phase of the printing press.

10. A device for measuring deviations relating to color register and/or lateral register on printing material during production in printing presses, the device comprising:

a register measuring device configured to determine ghosting effects on the printing material by measuring deviations in a measuring process; and a computing unit configured to receive register deviations including the ghosting effects contained therein as determined by said register measuring device during the measuring process, said computing unit configured to determine a proportion of the ghosting effects in the measured deviations by recursively calculating at least the ghosting effects of a preceding and/or succeeding printed image as an impact on the measured printing material using calculation software run in said computing unit.

11. The device according to claim 10, wherein said computing device is configured for use with the printing material being in the shape of sheets.

12. The device according to claim 10, wherein the device is a measuring device for determining color register deviations or/and lateral register deviations.

13. The device according to claim 12, wherein the measuring device is a hand-held measuring device.

14. The device according to claim 12, wherein the measuring device is integrated into a color measuring device.

15. The device according to claim 14, wherein the color measuring device includes a measuring table for supporting sheet-shaped printing material and a measuring bar movable across the measuring table to sense measuring marks for determining color register deviations or/and lateral register deviations on the sheet-shaped printing material.

16. The device according to claim 10, wherein the device is configured to transmit correction commands calculated from recorded deviations to a control unit of the printing press.

* * * * *